US011678748B2

(12) United States Patent
Van Doornewaard et al.

(10) Patent No.: US 11,678,748 B2
(45) Date of Patent: Jun. 20, 2023

(54) UPHOLSTERY SUPPORT ARRANGEMENT, INCLUDING AIRFLOW ARRAYS FOR CONDITIONED FURNITURE, AND ASSOCIATED SYSTEMS AND METHODS

(71) Applicant: Pure-Development 1 B.V., Baarn (NL)

(72) Inventors: Barry Van Doornewaard, Baarn (NL); Michiel Maria Augustinus Steegmans, Baarn (NL)

(73) Assignee: Pure-Development 1 B.V., Baarn (NL)

( * ) Notice: Subject to any disclaimer, the term of this patent is extended or adjusted under 35 U.S.C. 154(b) by 0 days.

(21) Appl. No.: 17/198,098

(22) Filed: Mar. 10, 2021

(65) Prior Publication Data

US 2022/0287470 A1 Sep. 15, 2022

(51) Int. Cl.

| | |
|---|---|
| ***A47C 21/04*** | (2006.01) |
| ***A47C 7/74*** | (2006.01) |
| ***A47C 27/14*** | (2006.01) |

(52) U.S. Cl.

CPC ..... *A47C 21/044* (2013.01); *A47C 7/744* (2013.01); *A47C 27/14* (2013.01)

(58) Field of Classification Search

CPC ..... A47C 21/044; A47C 21/04; A47C 21/048; A47C 19/021; A47C 7/44; A47C 27/14; A61G 7/05784

See application file for complete search history.

(56) References Cited

U.S. PATENT DOCUMENTS

| | | | |
|---|---|---|---|
| 3,266,064 | A | 8/1966 | Murray |
| 3,513,490 | A | 5/1970 | Wagner |
| 3,736,604 | A | 6/1973 | Carson |
| 3,746,835 | A | 7/1973 | Yu et al. |
| 4,186,452 | A | 2/1980 | Underwood |
| 4,939,804 | A | 7/1990 | Grant |
| 5,408,711 | A | 4/1995 | McClelland |

(Continued)

FOREIGN PATENT DOCUMENTS

| | | | |
|---|---|---|---|
| CA | 2482406 | C | 9/2003 |
| CN | 2191584 | Y | 3/1995 |

(Continued)

OTHER PUBLICATIONS

Freshbed, "FreshBed iFo 3D-Animation," (https://www.youtube.com/watch?v=j9J3elNZuu0), Nov. 18, 2020.

(Continued)

*Primary Examiner* — David R Hare
*Assistant Examiner* — Alison N Labarge
(74) *Attorney, Agent, or Firm* — Perkins Coie LLP

(57) ABSTRACT

Upholstery support arrangements for conditioned furniture are disclosed herein. A representative arrangement, such as for a ventilated bed, comprises an upholstery support structure having a support platform that defines a support plane, for supporting an upholstery item, the upholstery support platform having a first array of apertures that allow a flow of air through the support platform; the upholstery supported on the support platform (e.g., a mattress) having a bottom face facing the support platform and including a second array of apertures positioned to allow the flow of air through the bottom face into the upholstery; wherein a periodicity of the first array of apertures and a periodicity of the second array of apertures are matched to one another.

15 Claims, 5 Drawing Sheets

(56) References Cited

U.S. PATENT DOCUMENTS

| | | | | |
|---|---|---|---|---|
| 5,678,352 | A | 10/1997 | Leitner et al. | |
| 5,887,304 | A * | 3/1999 | von der Heyde | A47D 15/001 5/724 |
| 6,584,627 | B1 * | 7/2003 | Yang | A47C 23/26 5/174 |
| 7,178,183 | B2 | 2/2007 | Cho | |
| 7,837,932 | B2 | 11/2010 | Hedman | |
| 8,272,143 | B1 | 9/2012 | Hedman | |
| 9,131,675 | B2 | 9/2015 | Smith | |
| 9,756,952 | B2 | 9/2017 | Alletto, Jr. et al. | |
| D819,357 | S | 6/2018 | van Doornewaard | |
| 2003/0019044 | A1 | 1/2003 | Larsson et al. | |
| 2003/0070235 | A1 | 4/2003 | Suzuki et al. | |
| 2003/0145380 | A1 | 8/2003 | Schmid | |
| 2004/0253920 | A1 * | 12/2004 | Schoettle | A47C 21/044 454/907 |
| 2005/0229319 | A1 | 10/2005 | Cho | |
| 2006/0053558 | A1 | 3/2006 | Ye | |
| 2006/0101577 | A1 | 5/2006 | Lussier | |
| 2007/0136952 | A1 | 6/2007 | Sargent | |
| 2008/0313810 | A1 | 12/2008 | Cretsinger et al. | |
| 2010/0005588 | A1 | 1/2010 | Christopher | |
| 2010/0011502 | A1 | 1/2010 | Brykalski et al. | |
| 2010/0115696 | A1 | 5/2010 | Felix, Jr. et al. | |
| 2010/0319125 | A1 | 12/2010 | Ko | |
| 2011/0296610 | A1 | 12/2011 | Moon et al. | |
| 2012/0186138 | A1 | 7/2012 | Bell et al. | |
| 2012/0233907 | A1 | 9/2012 | Pattison et al. | |
| 2012/0240451 | A1 | 9/2012 | Ricks | |
| 2012/0285944 | A1 | 11/2012 | Bermudez | |
| 2013/0061395 | A1 | 3/2013 | Karl et al. | |
| 2013/0263496 | A1 | 10/2013 | Maloney et al. | |
| 2013/0276358 | A1 | 10/2013 | Knote et al. | |
| 2014/0109314 | A1 | 4/2014 | Boersma et al. | |
| 2014/0137569 | A1 | 5/2014 | Parish et al. | |
| 2014/0173970 | A1 | 6/2014 | Martin | |
| 2014/0201909 | A1 | 7/2014 | Weyl | |
| 2014/0271349 | A1 | 9/2014 | Gowda et al. | |
| 2015/0208814 | A1 * | 7/2015 | Alletto, Jr. | A47C 27/00 5/423 |
| 2016/0136385 | A1 | 5/2016 | Scorcioni | |
| 2017/0202365 | A1 | 7/2017 | Polevoy et al. | |
| 2017/0296412 | A1 | 10/2017 | Hung | |
| 2017/0348182 | A1 | 12/2017 | Yoo et al. | |
| 2018/0110341 | A1 | 4/2018 | Reynolds | |
| 2018/0160819 | A1 | 6/2018 | Rutledge | |
| 2018/0271300 | A1 | 9/2018 | Wang | |
| 2019/0105458 | A1 | 4/2019 | Hammes et al. | |
| 2019/0126000 | A1 | 5/2019 | Main et al. | |
| 2019/0320808 | A1 * | 10/2019 | Chapin | A47C 21/044 |
| 2019/0380501 | A1 * | 12/2019 | Reynolds | A47C 21/044 |
| 2020/0170418 | A1 | 6/2020 | Oh et al. | |
| 2020/0198509 | A1 | 6/2020 | Conze et al. | |
| 2020/0237106 | A1 * | 7/2020 | Alletto, Jr. | A47C 27/007 |
| 2020/0397148 | A1 | 12/2020 | Elliott et al. | |
| 2021/0204709 | A1 | 7/2021 | Grabinger et al. | |
| 2021/0204720 | A1 * | 7/2021 | Karschnik | A47C 27/081 |
| 2021/0227987 | A1 | 7/2021 | Alletto, Jr. et al. | |
| 2021/0307524 | A1 | 10/2021 | Nishida et al. | |
| 2021/0307525 | A1 | 10/2021 | Kim et al. | |
| 2021/0307529 | A1 | 10/2021 | Kim et al. | |
| 2021/0307531 | A1 * | 10/2021 | Lee | A47C 27/053 |

FOREIGN PATENT DOCUMENTS

| | | | |
|---|---|---|---|
| CN | 204105404 | U | 1/2015 |
| DE | 102017003332 | A1 | 10/2018 |
| EP | 1804616 | B1 | 2/2012 |
| EP | 0957727 | B1 | 3/2022 |
| GB | 379439 | A | 9/1932 |
| GB | 2334889 | A | 9/1999 |
| JP | S5670719 | A | 6/1981 |
| JP | H04108411 | A | 4/1992 |
| JP | H09140506 | A | 6/1997 |
| KR | 20140071931 | A | 6/2014 |
| KR | 20180053024 | A | 5/2018 |
| KR | 20200092139 | A | 8/2020 |
| KR | 20200002751 | U | 12/2020 |
| WO | 1996039905 | A1 | 12/1996 |
| WO | 2005120295 | A1 | 12/2005 |
| WO | 2013017869 | A1 | 2/2013 |

OTHER PUBLICATIONS

Partial search report issued for corresponding NL Application No. 2027736, Applicant: Pure-Development 1 B.V., dated Dec. 8, 2021, 10 pages.

International Search Report and Written Opinion dated Apr. 21, 2022 in International Application No. PCT/NL2022/050130, 14 pages.

* cited by examiner

UPHOLSTERY SUPPORT ARRANGEMENT, INCLUDING AIRFLOW ARRAYS FOR CONDITIONED FURNITURE, AND ASSOCIATED SYSTEMS AND METHODS

TECHNICAL FIELD

The present technology is directed generally to a support arrangement, including airflow arrays for supporting upholstery (including a mattress, or cushions) of conditioned furniture, and associated systems and methods.

BACKGROUND

Beds having integral air-ventilation (so-called "ventilated beds") typically include a permeable mattress supported by a support platform. The platform includes internal plenums and a fan to provide filtered, as well as heated, airflow up through the permeable mattress of the bed and into contact with a recumbent user, as controlled by the user. It is believed that providing a user in bed with a controlled up-flow of conditioned air improves the comfort and quality of the user's sleep, as well as the user's overall health.

EP1804616A1 discloses environmentally conditioned furniture, such as a bed, with a permeable mattress or cushion set upon a plenum chamber base, with a ventilator fan, a distribution duct and heater, co-operatively disposed to intake ambient air and expel conditioned chamber air through the mattress under temperature and so relative humidity control, for the comfort and/or respiratory benefit of a bed occupant.

SUMMARY

When a mattress is supported on a mattress support platform, throughflow of air from below the mattress support to the surface of the mattress may be hampered, or blocked by a portion of the support platform, in particular when the mattress is not properly aligned with the support platform.

A representative embodiment of the present technology includes an upholstery support arrangement for supporting upholstery or an upholstered item, e.g., a mattress or a cushion. The technology can include a heated or otherwise conditioned furniture item, e.g. a bed or a seat. In particular embodiments, the present technology reduces (e.g., minimizes) blockage of apertures in the upholstery, and in particular the bottom face thereof, by the upholstery support platform, for example, if the upholstery is misaligned relative to the support platform or otherwise supported by the support platform in an orientation not necessarily intended during design thereof. Examples of suitable furniture include couches, chairs, convertible sofas, sleeper sofas, chaises lounges, and/ or any other suitable furniture that includes a mattress or cushion on which a person may sit and/or lie down.

Accordingly, a first aspect provides an upholstery support arrangement for a conditioned furniture item. The conditioning may include one or more of providing air through the upholstery or withdrawing air therefrom, heating, cooling, filtering, humidifying, dehumidifying, sterilising, scenting, de-scenting, and/or a combination thereof. The furniture item may include an upholstery support structure having a support platform for supporting upholstery (e.g. an upholstered item). Such item may be a cushion or a mattress.

A representative upholstery support platform includes a support array of apertures that allow a flow of air through the support platform. The upholstery may include a bottom face facing the support platform, wherein the bottom face includes an upholstery array of apertures that allow the flow of air through the bottom face into the mattress (or other upholstery). The upholstery bottom face has dimensions generally corresponding to support dimensions of the support platform such that in a pre-determined aligned position of the upholstery relative to the support platform, the bottom face is supported by the support platform.

The support array of apertures and the upholstery array of apertures have, respectively, a first support periodicity and a first upholstery periodicity, wherein the first support periodicity of the support array of apertures and the first upholstery periodicity of the upholstery array of apertures have a correspondence to each other, e.g., are matched to one another. The apertures in the support and upholstery arrays are periodically distributed over, respectively, the support platform and the upholstery bottom face, such that of the weight of the upholstery (e.g., a mattress), and a person lying on the upholstery, is evenly distributed over a support interface between the support platform and the upholstery bottom face. This means that the apertures may be periodically distributed over one or two axis; in the latter case, the two axes are perpendicular to one another. The support interface defines a support plane. The support array of apertures and the upholstery array of apertures form, respectively, a throughflow area in the support platform and a through flow area in the bottom face of the mattress, wherein the apertures are distributed over the support platform and the upholstery bottom face in such a way that the throughflow areas of the support platform and the throughflow area mattress bottom face generally overlap to provide sufficient airflow through the mattress regardless of how the mattress is positioned on the support platform.

For example, the apertures of the support array and the apertures of the upholstery array may be arranged to mutually align, when the mattress is in the intended pre-determined aligned position on the support platform. By arranging the apertures of the support array and the upholstery array both in a periodic manner, and matching their respective first periodicities, the apertures of the support array and of the upholstery array also mutually align in various misaligned positions of the mattress relative to the support platform. Hence, the overlap of the throughflow areas of the support platform and the bottom face remains generally constant at various relative positions and/or configurations of the mattress on the support platform.

The periodicity of the first and upholstery arrays may be regarded as a distance between neighbouring apertures, e.g. the distance between two neighbouring aperture centers or, alternatively or additionally, the inverse thereof—in which case the periodicity may be regarded as a frequency, rather than a period.

The periodicity of the support array may be defined in one dimension and/or two dimensions of the support platform. For instance, the apertures of the support array may be formed by a lattice structure of the support platform, such that the apertures of the support array are distributed over the support platform in a periodic fashion.

Similarly, the periodicity of the upholstery array may be defined in one dimension and/or two dimensions of the bottom face. For instance, the apertures of the upholstery array may be formed by a lattice structure of the support platform, such that the apertures of the upholstery array are distributed over the bottom face in a periodic fashion.

In an embodiment, the support array of apertures has a first support periodicity in a first, e.g. longitudinal, support direction of the support platform. The upholstery array of apertures has a first mattress periodicity in a first, e.g. longitudinal, mattress direction of the bottom face. The first support direction and the first mattress direction are parallel to each other. The first support periodicity of the support array and the first mattress periodicity of the upholstery array are matched to one another.

In an embodiment, the support array of apertures has a second support periodicity in a second, e.g. transverse, support direction of the support platform. The upholstery array of apertures has a second mattress periodicity in a second, e.g. transverse, mattress direction of the bottom face. The second support direction and the second mattress direction are parallel to each other. The second support direction is transverse to the first support direction. The second mattress direction is transverse to the first mattress direction. The second support periodicity of the support array and the second mattress periodicity of the upholstery array correspond to (e.g., are matched to) one another.

In an embodiment, the first mattress periodicity is at most half the first support periodicity. For example, the apertures of the support array may be periodically spaced apart by a first support period, and the apertures of the upholstery array may be periodically spaced apart by a first mattress period, wherein the first mattress period is at most half the first support period.

In an embodiment, the second mattress periodicity is at most half the second support periodicity. For example, the apertures of the support array may be periodically spaced apart by a second support period, and the apertures of the upholstery array may be periodically spaced apart by a second mattress period, wherein the second mattress period is at most half the second support period.

In an embodiment, a spacing between neighbouring apertures of the upholstery array, e.g. a distance between the aperture centers of the neighbouring apertures, corresponds to a dimension of the apertures of the support array. Hence, the spacing of the apertures of the upholstery array being matched to the aperture size of the apertures of the support array, provides that a significant portion of the throughflow areas of the mattress bottom face and the support platform overlap, in any relative displacement of the mattress and the support platform.

For example, in a first relative position of the mattress bottom face and the support platform, an aperture of the support array may overlap with a first one of two neighbouring apertures of the upholstery array. In a second relative position which is shifted from the first relative position, the aperture of the support array may overlap with a second one of two neighbouring apertures of the upholstery array. Also, in an intermediate relative position, intermediate the first and second relative positions, the aperture of the support array may partly overlap with both the first and the second neighbouring apertures of the upholstery array. Hence, for any relative displacement of mattress on the support platform, the overlap in the throughflow areas of the mattress bottom face and the support platform remains generally constant.

The apertures of the support array may have identical shapes and sizes. Also, the apertures of the upholstery array may have identical shapes and sizes. It will be appreciated that the shapes and sizes of the apertures of the support array can be different than the shapes and sizes of the apertures of the upholstery array.

In an embodiment, the upholstery array of apertures comprises a plurality of periodically spaced rows of apertures, wherein each second row of the upholstery array is staggered with respect to an adjacent row. Hence, a staggered array of apertures is obtained, which provides an effective distribution of the apertures over the mattress bottom face. It moreover accounts for a skewed positioning of the mattress with respect to the support platform. This skewed positioning has proven to provide an improved rigidity of the upholstery array. For example, in the context of a mattress, at least one of: all of the mattress, a top layer of the mattress, and a bottom layer of the mattress—is not very rigid. It is noted that non-skewed embodiments may be used as well.

In an embodiment, each second row of the upholstery array is staggered with respect to an adjacent row by half a period of the first mattress periodicity. Additionally or alternatively, each second row of the upholstery array is staggered with respect to an adjacent row by half a period of the second mattress periodicity.

In an embodiment, the mattress support platform is at least partly formed by a plurality of periodically spaced slats that extend in, or are parallel to, the support platform, and wherein, between the slats, the apertures of the support array of apertures are, at least partly, defined. The apertures of the support array may, for example, be shaped as elongated slits. The slats can extend in the longitudinal direction and/or the transverse direction of the support plane.

In an embodiment, the slats extend in the second, e.g. transverse, support direction of the support platform, and are periodically spaced apart in the first, e.g. longitudinal, support direction of the support platform, wherein the spacing between the slats corresponds to a dimension of the slats in the first support direction. The slats are for example identically dimensioned, e.g. rectangular, wherein a dimension of the slats in the first support direction is equal to the spacing defined between the slats. The support array could, thus for instance, be a one-dimensional array, e.g. extending in the first mattress direction.

In an embodiment, the support array of apertures is symmetrically arranged with respect to the mattress support platform. Hence, the mattress can be placed on the support platform in at least two opposite configurations, e.g. the head-side and foot-side of the mattress may be interchanged with respect to the support platform, without altering the interaction between the first and upholstery arrays. The support array may, for instance, be symmetric with respect to a centreline in the first, e.g. longitudinal, support direction and/or with respect to a centreline in the second, e.g. transverse, support direction of the support platform. For instance, the support array of apertures are contained in a ventilation area of the support platform, wherein the ventilation area is centrally located in the support platform.

In a second aspect is provided a mattress. The mattress may be a mattress configured in accordance with the mattress of the arrangement of the first aspect, but it may also be an alternative mattress. The second aspect may also provide a mattress in accordance with a third aspect, described below, but it may also provide an alternative mattress. The mattress according to the second aspect comprises a bottom face for facing a mattress support platform, the bottom face having a ventilation area with a plurality of apertures. Each aperture provides access to one or more ventilation channels that extend at least partly through the mattress from the bottom face to a top face opposite the bottom face. The ventilation area is located asymmetrically with respect to bottom face from a head-end of the bottom face, towards a foot-end of the bottom face. Hence, a head-end of the mattress bottom face does not comprise any apertures. The head-end may thus be free of apertures, and therefore receives no airflow. This may be desirable because the sensation of an airflow around the head of user may be perceived as unpleasant.

The ventilation area defines an area of the mattress bottom face that is intended for allowing a flow of air therethrough. The ventilation area of the mattress may contain the upholstery array of apertures as described herein.

The mattress bottom face may also include a non-ventilation area that is substantially air-impermeable, e.g. does not comprise any apertures. The non-ventilation area may be arranged at or near a head-end of the mattress bottom face.

In a third aspect, a mattress is provided, which may be a mattress in accordance with the mattress of the mattress support arrangement of the first aspect, but it may also provide an alternative mattress. The third aspect may also provide a mattress in accordance with the second aspect, but it may also provide an alternative mattress. The mattress according to the third aspect, comprises a bottom face for facing a mattress support platform, the bottom face having a ventilation area with a plurality of apertures; a top face, opposite the bottom face, for supporting a user thereon; and a generally air impermeable sidewall, connected to the top face and to the bottom face, the sidewall being provided generally all around the perimeter of the mattress. Hence, a flow of air that has passed through the ventilation area of the bottom face, is prevented from escaping laterally, through the air-impermeable side wall. The air will thus be directed upward, i.e. from the bottom face towards the top face, wherein the air may escape from the mattress through the top face. This way, the air flow ventilates (e.g., optimally ventilates) the mattress. Also, the environment of the user supported on the top face of the mattress can be efficiently conditioned. Further, a spread, duvet or other covering provided on the top face of the mattress will also be subjected to the flow of air.

It will be appreciated that any one or more of the above aspects, features and embodiments can be combined. It will be appreciated that any one of the embodiments described in view of one of the aspects can be applied equally to any of the other aspects. It will also be clear that all aspects, features and embodiments described in view of the mattress support arrangement apply equally to mattresses and vice versa.

BRIEF DESCRIPTION OF THE DRAWINGS

The present technology will further be elucidated on the basis of representative embodiments which are represented in the drawings. The representative embodiments are provided by way of non-limitative illustration. It is noted that the figures are only schematic representations of embodiments of the present technology that are given by way of non-limiting example.

In the drawings.

DETAILED DESCRIPTION

Figure 1A:
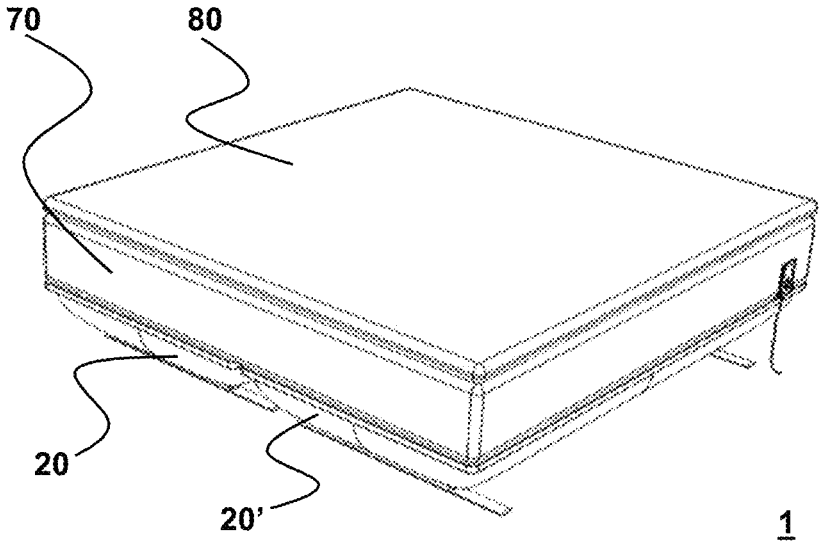
FIGS. 1A and 1B show representative beds configured in accordance with embodiments of the present technology.

FIG. 1A shows a first representative bed construction 1. The bed construction 1 provides a double bed. The bed construction comprises a support having a first outer shell 20 for supporting a first person, a second outer shell 20' for supporting a second person, a mattress 70 as a first upholstered item, supported at least partially by the first outer shell 20 and the second outer shell 20' and a topper mattress 80 as a second upholstered item.

Figure 1B:
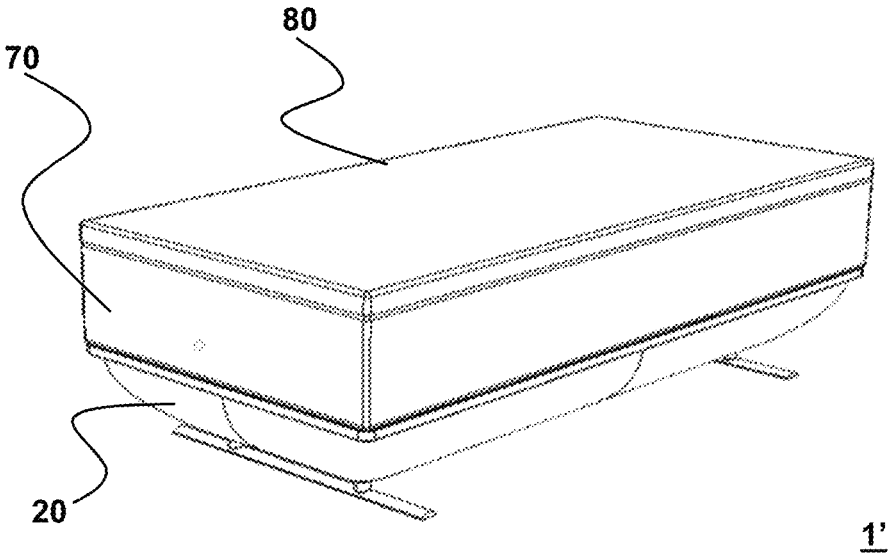

FIG. 1B shows another representative first bed construction 1'. The bed construction 1' provides a single bed. The bed construction comprises a support having an outer shell 20, a mattress 70 as a first upholstered item, supported by the outer shell 20, and a topper mattress 80 as a second upholstered item.

Figure 2A:
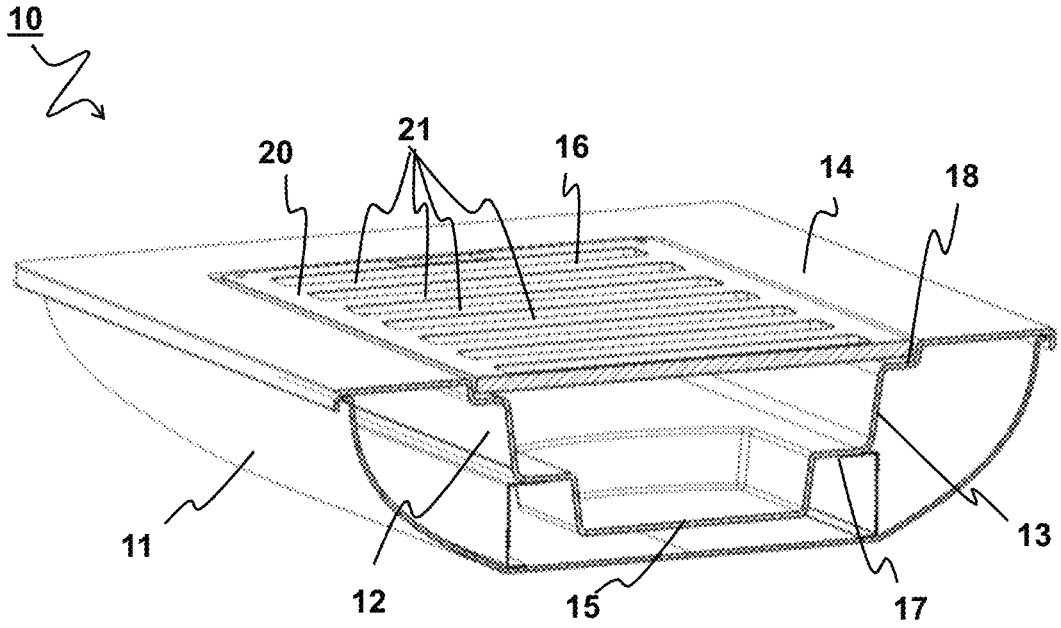
FIGS. 2A and 2B show a mattress support structure configured in accordance with embodiments of the present technology for a mattress support arrangement.
Figure 2B:
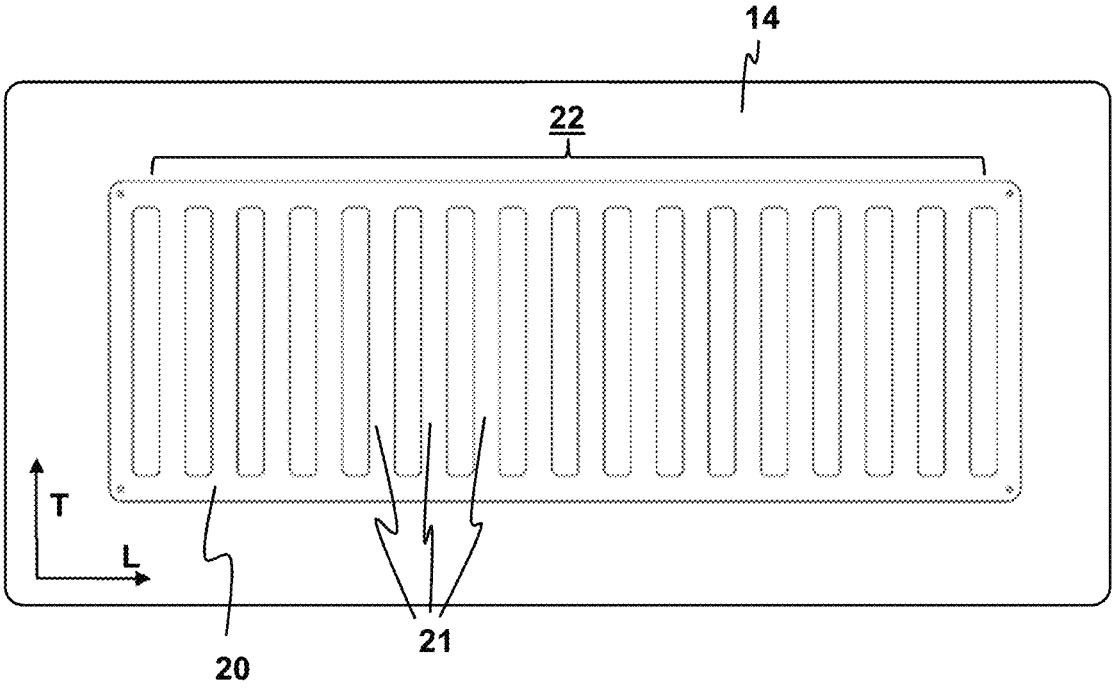

FIGS. 2A and 2B show a partially schematic example of a mattress support structure 10 as part of a bed 1. FIG. 2A shows a perspective view of a cross-sectioned support structure 10, and FIG. 2B shows a top view of the support structure 10. Here, the support structure 10 comprises a tub-shaped outer shell 11 with an open top. The tub shaped outer shell 11 forms a cavity for accommodating a ventilation unit, e.g. a fan and a heater. An inner shell 12 of the support structure 10 extends above the outer shell 11, and includes a central recessed portion 13, recessed toward a bottom of the outer shell 11.

The inner shell 12 forms, at least partly, a mattress support platform 14 for supporting a mattress, or another type of upholstery or upholstered item. In particular, a peripheral portion of the inner shell 12 forms, at least a part of, the mattress support platform 14. The mattress support platform 14 has an upper face which is positioned in a plane. A central recessed portion 13 is defined in part by an opening 16 in support platform 14, which extends below the plane. The opening 16 defines a ventilation area of the support platform 14. The opening 16, and hence the ventilation area of the support platform, is in this embodiment centrally located with respect to the support platform 14.

The inner shell 12 further comprises a support surface 17 for supporting the inner shell 12 on a base frame(not shown in FIG. 2A), as well as a seat 15 for holding the ventilation unit.

Provided in the plane of the opening 16, is a slatted frame 20. The slatted frame 20 is supported by the inner shell 12. For example, the inner shell 12 may include a seat 18 for receiving the slatted frame. The seat 18 is recessed relative to the mattress support platform 14, such that a top face of the slatted frame is flush with the upper face of the support platform 14, to form a flat support plane.

The slatted frame 20 can extend in a first (e.g., longitudinal) support direction L and a second (e.g., transverse) support direction T. The slatted frame 20 may include a plurality of slats 21, that extend in the second direction T. In some embodiments, the transverse dimension of the support platform 14 (or a portion of it) in the second support direction T is smaller than the longitudinal dimension of the support platform 14 or a part thereof, in the first support direction L. Alternatively, the longitudinal dimension is defined by the target or desired position of a user of the bed; as such, the longitudinal dimension is defined parallel to the length of a person in a target (sleeping) position on the bed.

Between the slats 21, a first array of apertures 22 is positioned to allow a flow of air to pass therethrough. In this example, the first array of apertures 22 is a linear row of apertures, each aperture being formed as an elongated slit or rectangle that extends in the second support direction T, here a transverse direction of the platform, but it will be appreciated that the first array 22 can be two-dimensional. The apertures of the first array 22 are spaced apart in the first support direction L, here the longitudinal direction of the support platform, by a uniform spacing. In this example, the spacing between the slats 21 is equal to a width of the slats, but it will be appreciated that other ratios or relative values can be used in other embodiments. Furthermore, alternatively or additionally to the slatted frame 20, individual (e.g., non-connected) slats may be provided. Preferably, such individual slats are provided with spacers to establish and maintain the intended periodicity.

The first array 22 has a periodicity that is associated with the regular spacing between the slats. In this particular example, the first support periodicity of the first array 22, e.g., in the first support direction L, may be regarded as the distance between two neighboring apertures of the first array 22, e.g. the distance between two neighbouring slat centres. The first support periodicity has a correspondence to a second periodicity of a mattress or other upholstery carried by the support platform 14, as discussed further below.

Figure 3A:
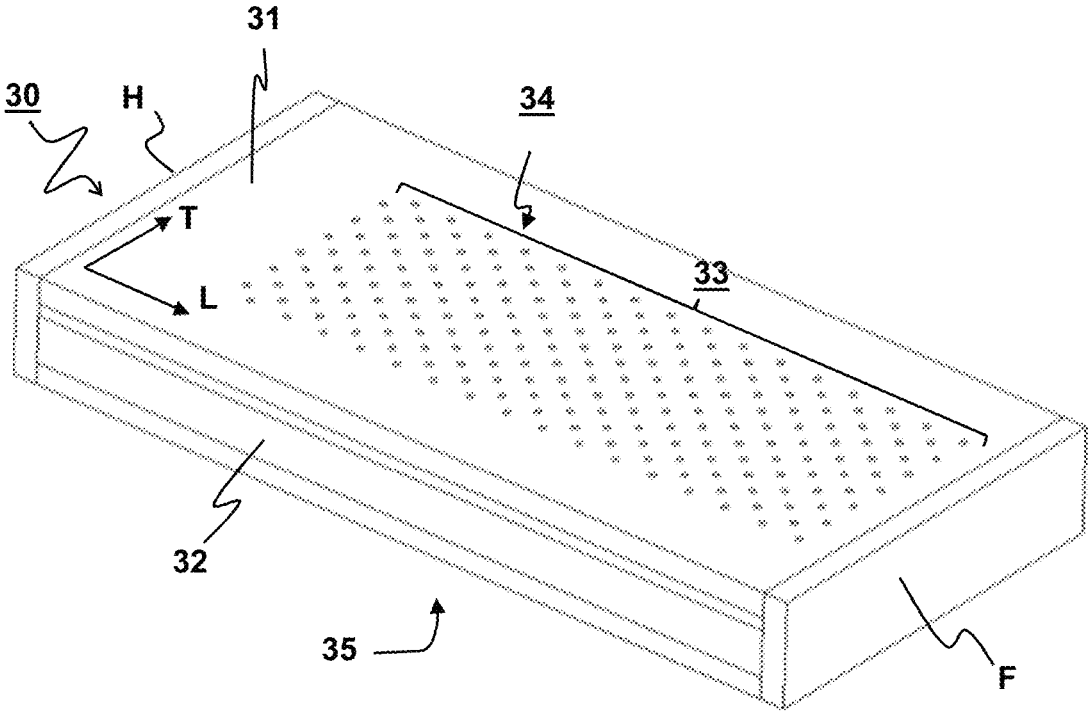
FIGS. 3A and 3B show a mattress for a mattress support arrangement configured in accordance with embodiments of the present technology.
Figure 3B:
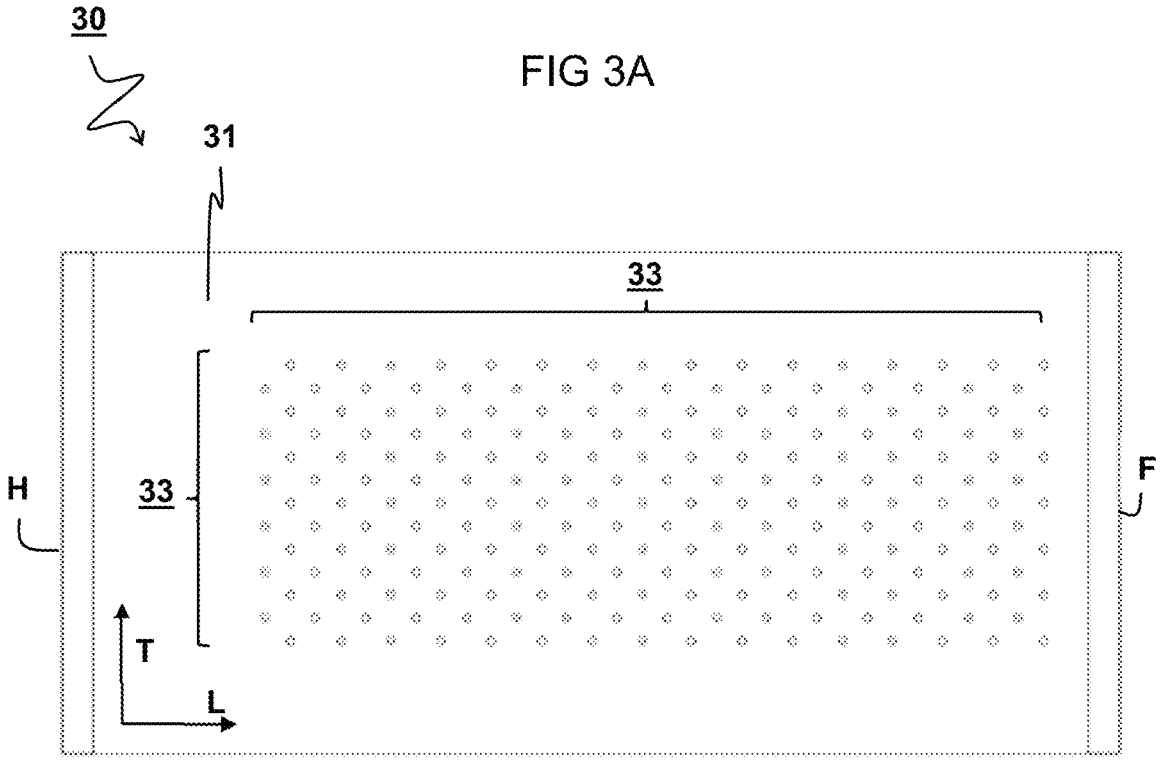

FIGS. 3A and 3B show, respectively, a perspective view and a bottom view of a mattress 30. The mattress 30 can be supported by the support structure as shown in FIGS. 2A and 2B. The mattress 30 has a bottom face 31 for facing the support platform 14. When supported on the support platform 14, the bottom face 31 is generally coplanar with the upper face of the support platform 14, such that a support plane is defined at the support interface between the mattress bottom face 31 and the support platform 14.

The mattress also comprises a top face 35, opposite the bottom face 31, for supporting a user thereon. The top face 35 can be shaped to be identical to or at least similar to the bottom face 31. A side wall 32 extends around the mattress 30 and connects the top face and the bottom face 31. The side wall 32 is optionally impermeable or at least approximately impermeable to air, and may include a closed-cell foam, though other materials may be used as well, for example, real leather and/or imitation leather. In this embodiment, the side wall 32 is provided between the bottom face 31 and the top face 35. In another embodiment, the side wall also surrounds or partially surrounds or overlaps the bottom face and the top face 35.

The bottom face 31 of the mattress 30 includes a ventilation area 34 that allows air to pass through the bottom face 31 into the mattress 30. The ventilation area 34 comprises a plurality of apertures, which are arranged in a second array of apertures 33. Here, the ventilation area 34 is asymmetrically arranged with respect to the mattress bottom face 31, e.g., it is offset towards a foot-end F of the mattress bottom face 31. Hence, a head-end H of the mattress bottom face 31 is free of apertures, and is generally impermeable to air. In other embodiments, at least one of the bottom face 31 and the top face 35 are symmetrical, in the sense that apertures are also provided at the head-end H.

In the illustrated example, the apertures of the second array 33 are equally shaped circular apertures, which are periodically distributed over the ventilation area 34 of the mattress bottom face 31. A first mattress periodicity of the second array 33 in the first mattress direction, here in the longitudinal direction L, may be regarded as the distance between two subsequent apertures of the second array 33, e.g. the distance between two neighbouring aperture centres over the length of the mattress 30.

Similarly, a second mattress periodicity of the second array 33 in the second mattress direction, here the transverse direction T, may be regarded as the distance between two subsequent apertures of the second array 33, e.g. the distance between two neighbouring aperture centres over the width of the mattress 30. A periodicity of the second array 33 may also be regarded in any other direction in the bottom face 31, e.g. a combination of the longitudinal and transverse direction.

Figure 5A:
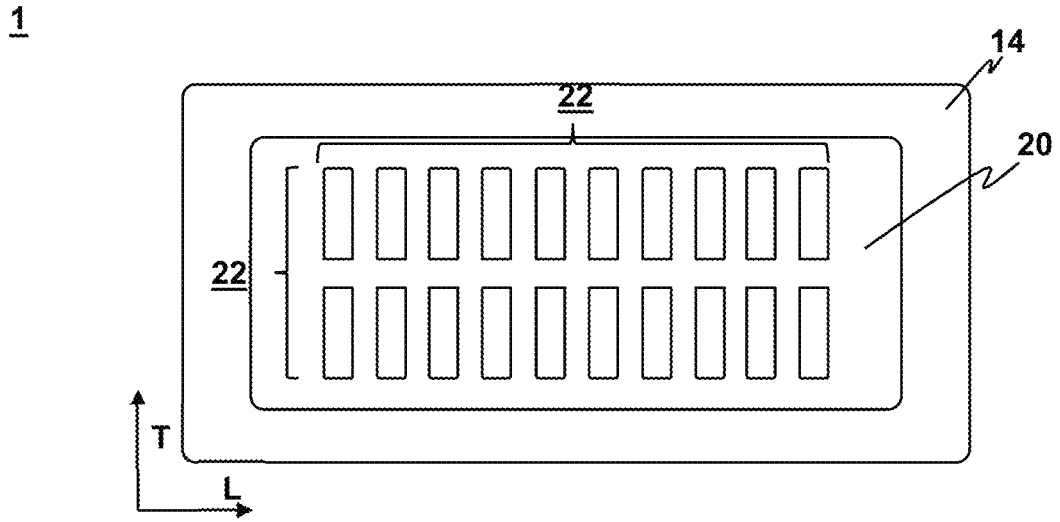
FIGS. 5A-5C show a mattress support arrangement configured in accordance with embodiments of the present technology.
Figure 5B:
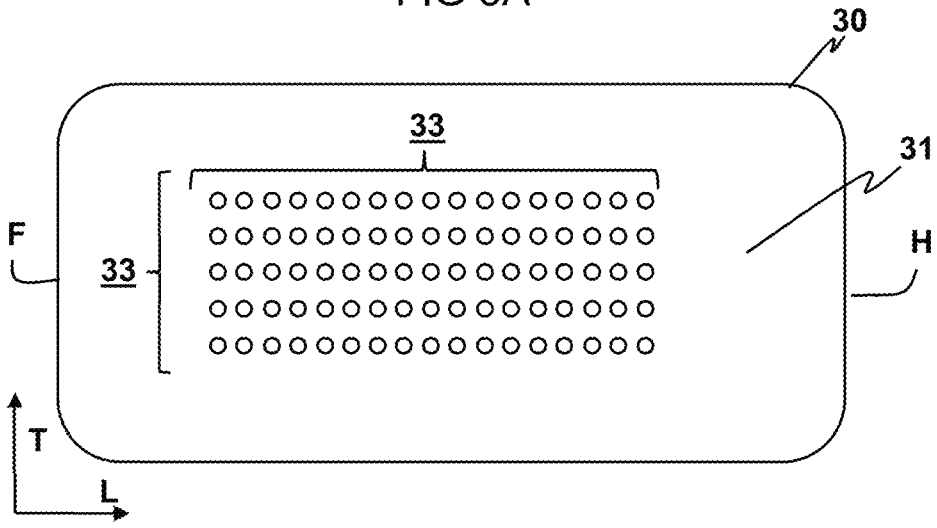
Figure 5C:
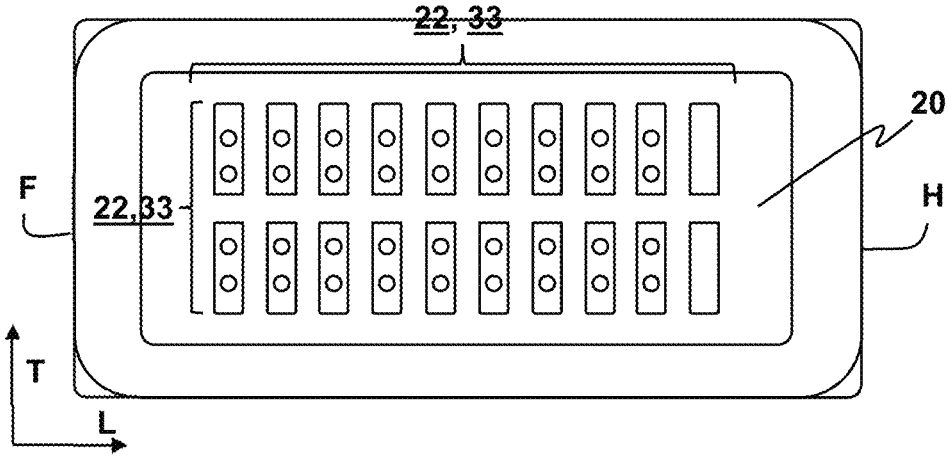

Here, the second array 33 is a staggered array, e.g., the second array 33 includes a multitude of rows of apertures, wherein each second row is staggered with respect to an adjacent row. Each row includes a number of linearly spaced apertures, and the row extends in the transverse direction T. The spacing between the apertures of the second array 33 is double the spacing between the rows—viewed in either the transverse direction T or the longitudinal direction L, creating the staggered pattern as shown in FIG. 3A and FIG. 3B. An example of an unstaggered second array 33 is shown in FIGS. 5B and 5C.

The second array 33 may also be characterised as having multiple rows of apertures that are oriented diagonally relative to the major axes T, L of the mattress 30. Under this characterisation, the rows are not staggered and the periodicity of the rows is generally equal to the periodicity of the apertures with individual rows. The periodicities of the second array are, with this characterization, generally equal to the longitudinal spacing, divided by the square root of two. It is noted that whichever characterization is selected bears no influence on the scope of the claims.

FIGS. 4A-4C, and FIGS. 5A-5C show partially schematic views from the bottom of the mattress support structure 10, wherein the mattress 30 is supported on the support platform 14. To show the interaction between the first array of apertures 22 and the second array of apertures 33, only the slatted frame 20 is depicted, and the rest of the support structure is omitted, for clarity. Hence, the support plane is generally in or parallel to the plane of the drawing of FIGS. 4A-4C, and 5A-5C.

Figure 4A:
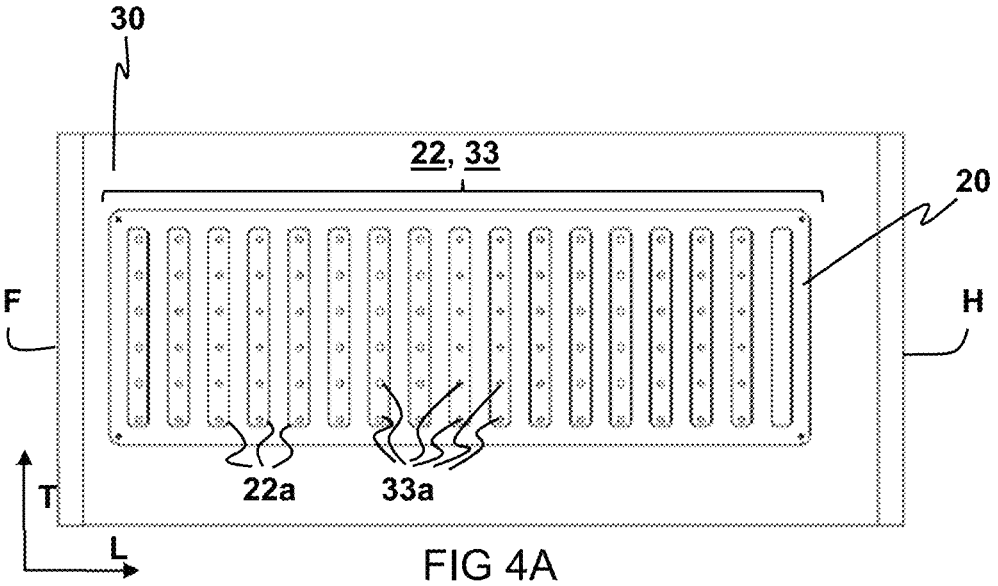
FIGS. 4A-4C show a mattress support arrangement configured in accordance with embodiments of the present technology.

FIG. 4A shows a representative baseline configuration of the mattress 30 on the support platform 14. In this configuration, the mattress 30 is aligned with the support platform and the slatted frame 20 such that the mattress 30 is fully supported by the support platform. In this pre-determined aligned configuration, the apertures of the first array 22 in the support platform 14 and the apertures of the second array 33 in the mattress bottom face 31 are fully aligned, e.g., each aperture 33*a* of the second array 33 is aligned with an aperture 22*a* of the first array 22.

A flow of air, induced by the ventilation unit, can thus pass through the support plane provided by the mattress support platform 14 and the slatted frame 20, e.g., through the first and second aperture arrays 22, 33, and into the mattress 30. As can be seen in FIG. 4A, a periodicity of the first array 22 and a periodicity of the second array 33 are "matched" to one another. As used herein, the term "matched" means mated with or tied with, or paired with—it does not necessarily mean "equal to." In particular, this example shows that a first mattress periodicity, e.g. the longitudinal spacing between adjacent apertures of the second array 33, is matched to a first support periodicity of the first array 22. Here, a first mattress period of the second array 33 is half a period of the first support period of the first array 22. In other words, the longitudinal spacing between adjacent apertures of the second array 33, is half the spacing between adjacent apertures of the first array 22. Hence, every second row of the second array 33 is blocked by the slats 21 of the slatted frame 20 and every first row is not blocked. Such effect may be obtained by making the spacing between adjacent apertures 22*a* of the first array 22 any even number larger than the longitudinal spacing between adjacent apertures 33*a* of the second array 33.

Accordingly, in this example, the spacing between neighbouring apertures of the second array 33 corresponds to a dimension of the apertures of the first array 22. For example, this correspondence may be described by a mathematical relation. More specifically, the distance between apertures 22*a* in the first array 22 may be the same or half the distance between apertures 33*a* in the second array. As such, the first array and the second array are considered as "matching" or, more generally "corresponding" if they satisfy in general a relation that a small shift—not more than 10% of the lengths or width of the mattress—of the first array 22 and the second array 33 in any direction does not significantly reduce (e.g., does not reduce, or reduces by 10% or less) the overlap of the apertures 22*a* in the first array 22 and the apertures 33*a* in the second array 33.

It will be appreciated that a second mattress periodicity, e.g., a periodicity in the transverse direction of the second array 33, can be similarly matched to a second support periodicity of the first array 22. In this case, the first array 22 is a one dimensional array that only varies in the longitudinal direction, but it will be understood that the first array 22 can also be two-dimensional. An example of an alternative first array 22 is show is shown in FIGS. 5A and 5C.

Figure 4B:
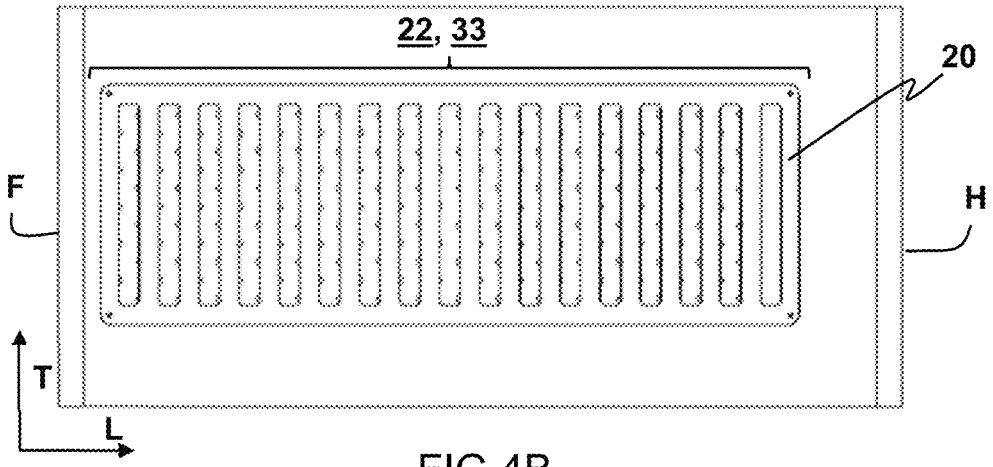
Figure 4C:
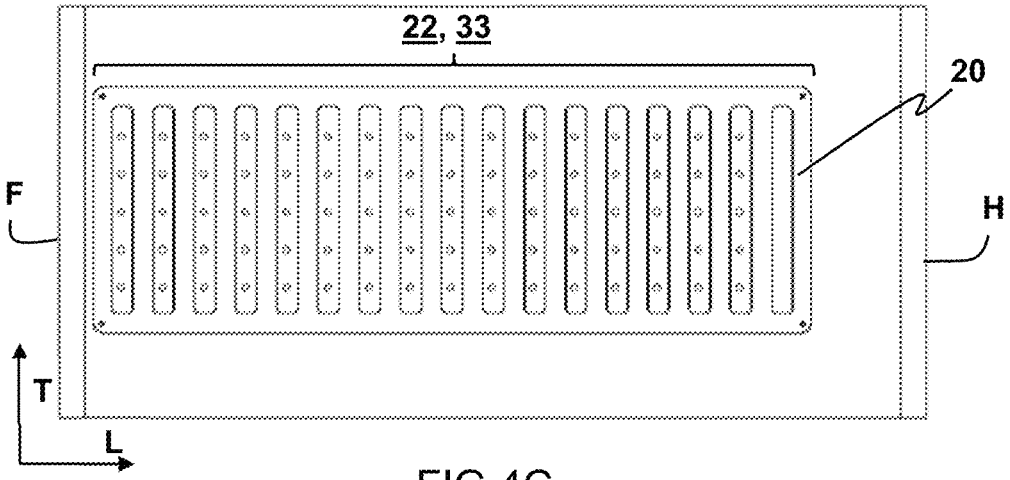

FIGS. 4B and 4C show respective configurations wherein the mattress 30 has been shifted, in the longitudinal direction of the support plane, with respect to the support platform 14.

FIG. 4C shows a shift of the mattress 30 in the longitudinal direction L relative to the support platform 14, by a distance that equals the longitudinal spacing of the rows of the second array 33. This shift distance also equals the longitudinal spacing of the apertures of the first array 22. In this example, the shift distance also corresponds to a dimension of the aperture of the first array 22 in the longitudinal direction, here the spacing between the slats 21.

FIG. 4B shows a shift of the mattress 30 in the longitudinal direction relative to the support platform 14, by a shift distance that is between the shift distances shown in FIGS. 4A and 4C. It can be seen that apertures of first array 22 and the second 33 array partly overlap, but that the overlap area is generally equal to the overlap area of the properly aligned configuration of FIG. 4A. It will be understood that any relative shift of the mattress between the configurations of FIGS. 4A and 4C, also results in a generally equal flow-through area as the baseline configuration of FIG. 4A. Here, the mattress 30 has been shifted relative to the support platform 14 by a distance that corresponds to half the longitudinal spacing between adjacent apertures of the second array 33. Also, the relative shift of the mattress 30 corresponds to half the longitudinal dimension of the apertures of the first array 22, here the spacing between the slats 21. In this way, a slight deviation in alignment between the mattress 30 and the support platform does not have a significant influence on the transmission of air from underneath the slatted frame 20 to the top face 35 of the mattress.

FIG. 5A shows a top view of a support surface 14 of a support structure, similar to the support surface shown in FIG. 2B. In the example of FIG. 5A, the first array 22 is a two dimensional array that varies in the longitudinal direction and the transverse direction of the support platform. In this case, the second array 22 of apertures 22*a* is formed by slatted frame 20, having an alternative configuration to the slatted frame shown in FIGS. 2-4.

FIG. 5B shows a bottom view of a mattress 30, wherein the bottom face 31 includes a second array 33 of apertures. The mattress of FIG. 5A is similar to the mattress 30 shown in FIGS. 1-3, but in this example, the second array 30 is an un-staggered array, FIG. 5C shows the baseline configuration of the mattress 30 of FIG. 5B on the support platform 14 of FIG. 5A. In this configuration, the mattress 30 is aligned with the support platform 14 and the slatted frame 20 such that the mattress 30 is fully supported by the support platform. In this pre-determined aligned configuration, the apertures of the first array 22 in the support platform 14 and the apertures of the second array 33 in the mattress bottom face 31 are properly aligned. Analogous to the mattress support arrangement, as shown in FIGS. 4A-4C, a deviation in alignment between the mattress 30 and the support platform does not have a significant influence on the transmission of air from underneath the slatted frame 20 to the top face 35 of the mattress.

Herein, the present technology is described with reference to specific examples of embodiments of the present technology. It will, however, be evident that various modifications, variations, alternatives and changes may be made therein, without departing from the essence of the present technology.

For the purpose of clarity and a concise description features are described herein as part of the same or separate embodiments, however, alternative embodiments having combinations of all or some of the features described in these separate embodiments are also envisaged and understood to fall within the framework of the present technology as outlined by the claims. The specifications, figures and examples are, accordingly, to be regarded in an illustrative sense rather than in a restrictive sense. The present technology is intended to embrace all suitable alternatives, modifications and variations which fall within the spirit and scope of the appended claims. Further, many of the elements that are described are functional entities that may be implemented as discrete or distributed components or in conjunction with other components, in any suitable combination and location.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage.

As used herein, the term "and/or," as in "A and/or B" refers to A alone, B alone and both A and B. As used herein, the terms "about" and "approximately" refer to values within 10% of the stated value.

The following examples provide additional embodiments of the present technology:

1. An upholstery arrangement for a conditioned furniture item, comprising:

an upholstery support structure having a support platform, the support platform having a support array of apertures positioned to allow a flow of air through the support platform;

upholstery carried by the support platform, and having a bottom face facing the support platform, the upholstery including an upholstery array of apertures positioned to allow the flow of air through the bottom face into the upholstery;

wherein:

the upholstery bottom face has upholstery dimensions corresponding to support dimensions of the support platform such that in a pre-determined aligned position of the upholstery relative to the support platform, the bottom face is supported by the support platform;

the support array has a first support periodicity;

the upholstery array has a first upholstery periodicity; and the first upholstery periodicity and the first support periodicity correspond to one another.

2. The upholstery arrangement of example 1, wherein the first support periodicity provided in a first support direction of the support platform and the first mattress periodicity provided in a first mattress direction of the bottom face are correspond to one another, the first support direction and the first mattress direction being parallel to one another in the pre-determined alignment position.

3. The upholstery arrangement of example 2, wherein:

the support array has a second support periodicity;

the upholstery array has a second upholstery periodicity; and the second support periodicity provided in a second support direction of the support platform and the second upholstery periodicity provided in a second upholstery direction of the bottom face correspond to one another, the second support direction and the second upholstery direction being perpendicular to the first support direction and the first upholstery direction, respectively.

4. The upholstery arrangement of example 2 or 3, wherein the first upholstery periodicity is at most half the first support periodicity.

5. The upholstery arrangement of any of examples 2-4, wherein the second upholstery periodicity is at most half the second support periodicity.

6. The upholstery arrangement any of examples 2-5, wherein a spacing between neighbouring apertures of the upholstery array corresponds to a dimension of the apertures of the support array.

7. The upholstery arrangement of any preceding example, wherein the upholstery array of apertures comprises a plurality periodically spaced rows of apertures, and wherein each second row of the upholstery array is staggered with respect to an adjacent row.

8. The upholstery arrangement of example 7, wherein each second row of the upholstery array is staggered with respect to an adjacent row by half a period of the first upholstery periodicity.

9. The upholstery arrangement of any preceding example, wherein the upholstery support platform is at least partly formed by a plurality of periodically spaced slats that extend in the support platform, and wherein, the slats at least partially define the support array of apertures.

10. The upholstery arrangement of any preceding example, wherein the support array of apertures is symmetrically arranged with respect to the upholstery support platform.

11. The upholstery arrangement of any preceding example, wherein the upholstery array of apertures provides access to one or more ventilation channels that extend at least partly through the upholstery from the bottom face of the upholstery to a top face opposite to the bottom face, wherein the ventilation area is located asymmetrically with respect to the bottom face, from a head-end of the bottom face towards a foot-end of the bottom face.

12. The upholstery arrangement of example 11, wherein the head-end is free of apertures.

13. The upholstery arrangement of example 11 wherein the upholstery has an at least approximately air impermeable sidewall, connected to the top face and to the bottom face, the sidewall being positioned around at least approximately the entire perimeter of the upholstery.

14. The upholstery arrangement of example 13, wherein the sidewall is positioned between the bottom face and the top face.

15. The upholstery arrangement of example 12 or 13, wherein the sidewall includes a closed-cell foam.

We claim:

1. An upholstery arrangement for a conditioned furniture item, comprising:

an upholstery support structure having a support platform, the support platform having a support array of apertures positioned within a ventilation area and to allow a flow of air through the support platform;

upholstery carried by the support platform, and having a bottom face facing the support platform, the upholstery including an upholstery array of apertures positioned to allow the flow of air through the bottom face into the upholstery;

wherein:

the upholstery bottom face has upholstery dimensions corresponding to support dimensions of the support platform such that in a pre-determined aligned position of the upholstery relative to the support platform, the bottom face is supported by the support platform;

the support array has a first support periodicity;

the upholstery array has a first upholstery periodicity; and the first upholstery periodicity and the first support periodicity correspond to one another; and wherein:

in a first relative position of the upholstery bottom face and the support platform, an aperture of the support array overlaps with a first one of two neighbouring apertures of the upholstery array; and in a second relative position, which is shifted from the first relative position, the aperture of the support array overlaps with a second one of the two neighbouring apertures of the upholstery array.

2. The upholstery arrangement of claim 1, wherein the first support periodicity provided in a first support direction of the support platform and the first upholstery periodicity provided in a first upholstery direction of the bottom face correspond to one another, the first support direction and the first upholstery direction being parallel to one another in the pre-determined aligned position.

3. The upholstery arrangement of claim 2, wherein:

the support array has a second support periodicity;

the upholstery array has a second upholstery periodicity; and the second support periodicity provided in a second support direction of the support platform and the second upholstery periodicity provided in a second upholstery direction of the bottom face correspond to one another, the second support direction and the second upholstery direction being perpendicular to the first support direction and the first upholstery direction, respectively.

4. The upholstery arrangement of claim 1, wherein the first upholstery periodicity is at most half the first support periodicity.

5. The upholstery arrangement of claim 3, wherein the second upholstery periodicity is at most half the second support periodicity.

6. The upholstery arrangement of claim 1, wherein a spacing between neighbouring apertures of the upholstery array corresponds to a dimension of the apertures of the support array.

7. The upholstery arrangement of claim 1, wherein the upholstery array of apertures comprises a plurality periodically spaced rows of apertures, and wherein each second row of the upholstery array is staggered with respect to an adjacent row.

8. The upholstery arrangement of claim 7, wherein each second row of the upholstery array is staggered with respect to an adjacent row by half a period of the first upholstery periodicity.

9. The upholstery arrangement of claim 1, wherein the support platform is at least partly formed by a plurality of periodically spaced slats that extend in the support platform, and wherein, the slats at least partially define the support array of apertures.

10. The upholstery arrangement of claim 1, wherein the support array of apertures is symmetrically arranged with respect to the support platform.

11. The upholstery arrangement of claim 1, wherein the upholstery array of apertures provides access to one or more ventilation channels that extend at least partly through the upholstery from the bottom face of the upholstery to a top face opposite to the bottom face, wherein the ventilation area is located asymmetrically with respect to the bottom face, from a head-end of the bottom face towards a foot-end of the bottom face.

12. The upholstery arrangement of claim 11, wherein the head-end of the upholstery is free of apertures.

13. The upholstery arrangement of claim 11, wherein the upholstery has an at least approximately air impermeable sidewall, connected to the top face and to the bottom face, the sidewall being positioned around at least approximately the entire perimeter of the upholstery.

14. The upholstery arrangement of claim 13, wherein the sidewall is positioned between the bottom face and the top face.

15. The upholstery arrangement of claim 13, wherein the sidewall includes a closed-cell foam.

* * * * *